US006717120B2

(12) United States Patent
Fritts et al.

(10) Patent No.: US 6,717,120 B2
(45) Date of Patent: Apr. 6, 2004

(54) SHIELDING SYSTEM FOR PROTECTING SELECT PORTIONS OF A FOOD PRODUCT DURING PROCESSING IN A CONVEYORIZED MICROWAVE OVEN

(75) Inventors: Rex E. Fritts, Cedar Rapids, IA (US); Shawn M. Garringer, Williamsburg, IA (US); Thomas Miller, Wellman, IA (US); John M. Osepchuk, Concord, MA (US)

(73) Assignee: Maytag Corporation, Newton, IA (US)

( * ) Notice: Subject to any disclaimer, the term of this patent is extended or adjusted under 35 U.S.C. 154(b) by 70 days.

(21) Appl. No.: 10/108,462

(22) Filed: Mar. 29, 2002

(65) Prior Publication Data

US 2003/0183623 A1 Oct. 2, 2003

(51) Int. Cl.[7] ..... H05B 6/78
(52) U.S. Cl. ..... 219/700; 219/729
(58) Field of Search ..... 219/700, 729, 219/699, 742, 744, 757, 738, 739, 762; 333/239; 34/259, 263; 99/338, 352

(56) References Cited

U.S. PATENT DOCUMENTS 3,881,403 A * 5/1975 Ingram et al. ..... 99/338
3,909,574 A * 9/1975 Muller et al. ..... 219/699
4,351,997 A 9/1982 Mattisson et al.
5,416,304 A 5/1995 De La Cruz et al.
5,958,278 A 9/1999 Engebritson et al.
6,442,866 B2 * 9/2002 Wefers ..... 34/263

FOREIGN PATENT DOCUMENTS

JP 4-19992 1/1992

* cited by examiner

*Primary Examiner*—Quang T. Van
(74) *Attorney, Agent, or Firm*—Diederiks & Whitelaw, PLC

(57) ABSTRACT

A conveyorized microwave oven incorporates a shielding system mounted within an oven cavity of the microwave oven. The shielding system is provided to prevent select portions of a food item traveling through the microwave oven from overheating relative to the remainder of the food item. The present invention is particularly adapted for use in connection with the tempering, cooking or thawing of parallelepiped or rectangular-shaped food items and includes a frame structure fixedly mounted within and traversing substantially the entire length of the oven cavity, with the frame structure having a generally rectangular cross-section defined by both microwave impermeable portions and microwave transmissive portions on each side.

17 Claims, 2 Drawing Sheets

SHIELDING SYSTEM FOR PROTECTING SELECT PORTIONS OF A FOOD PRODUCT DURING PROCESSING IN A CONVEYORIZED MICROWAVE OVEN

BACKGROUND OF THE INVENTION

1. Field of the Invention

The present invention pertains to the art of conveyorized microwave ovens and, more particularly, to a shielding system provided to protect select portions of a food item directed through a microwave oven on a conveyor from high intensity microwaves.

2. Discussion of the Prior Art

Conveyorized microwave ovens have been used for years in industrial and commercial cooking applications. In many cases, pre-packaged food items having a defined shape are passed through the oven during processing. Many of the packages and food items are in the form of parallelepipeds which have a plurality of corners or generally sharp projections. While the shape of the package or food item lends itself to convienent handling and storage, it can create a problem during the cooking process. More specifically, corners or sharp projections tend to magnify the microwave field, thereby creating localized hot spots within the food item. The localized hot spots result in uneven cooking, burning and even food spoilage. For instance, if a localized hot spot is created when it is desired to temper or thaw a food item, the food item may be heated beyond a desired level, thus essentially destroying the product.

In connection with microwave cooking in general, several methods have been proposed to shield the corners of food items being cooked. One example is close wrapping metal or aluminum foil over the edges of the food item. This is neither convenient nor cost effective, particularly for commercial, conveyorized microwave cooking systems. Other examples include placing a food item in special container designed to protect edges of the food item from exposure to the microwave energy. However, this proposal is also not considered reasonably feasible in connection with a continuous or substantially continuous microwave cooking system.

Based on the above, there exists a need in the art for a shielding system for a conveyorized microwave cooking process, particularly a shielding system capable of protecting corners, edges or sharp projections of a food item from direct exposure to the microwave energy field as the food item passes through a microwave cooking oven on a conveyor.

SUMMARY OF THE INVENTION

The present invention is directed to a conveyorized microwave oven which incorporates a shielding system designed to assure more even cooking for a food item traveling through the microwave oven. More particularly, the shielding system constitutes specific structure mounted within a cooking cavity of the microwave oven which prevents corners or edge portions of a parallelepiped-shaped food item traveling through the microwave oven from being excessively cooked relative to the remainder of the food item. In accordance with the most preferred form of the invention, the shielding system constitutes frame structure which traverses substantially the entire length of the cooking cavity, with the frame structure being formed from a microwave impermeable material that extends about the edge portions of the conveyor supported food items.

In a preferred form of the invention. the microwave impermeable portions of the frame structure are formed from metal, although other materials impermeable to microwave energy could be employed. The frame structure includes a plurality of sections which are preferably spaced from each other so as to define microwave transmissive zones which allow microwave energy to enter the center of the frame structure where the food item is located on the conveyor belt. The overall shielding system is specifically configured according to the shape and dimensions of the particular food item to be cooked. As the food items are moving through the shielding system, a clearance is maintained between the frame structure and the food item. In accordance with the invention, the clearance between the food item and the frame structure is preferably configured be less than ¼λ of the microwave energy.

When cooking food items in the microwave oven of the invention, food items are directed into the shielding system within the oven cavity upon the conveyor. The shielding system extends longitudinally within the oven cavity and is open at both ends. In this manner, predetermined portions of the food items are shielded from at least the full force of the microwave energy field during the cooking process. Most preferably, in addition to acting as a shield, the frame structure functions as a scatterer to effectively mix microwave modes and create surface waves that move along food item surfaces, thereby lessening the concentration of microwaves at the corners or edges of the food item.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
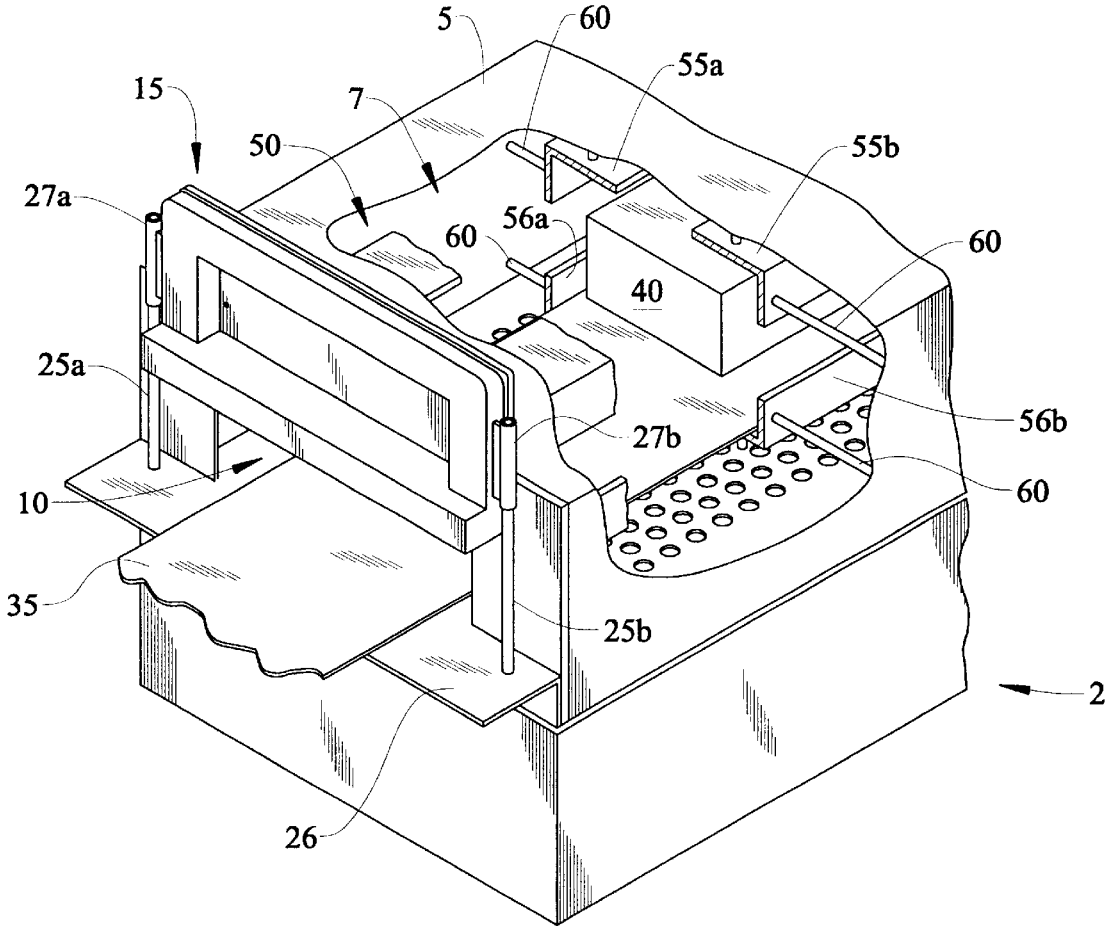
FIG. 1 is an isometric view of a conveyorized microwave oven having a central portion cut-away to depict the microwave shielding system of the invention.

With initial reference to FIG. 1, a conveyorized microwave oven constructed in accordance with the present invention is generally indicated at 2. In the most preferred form of the invention, oven 2 has an associated operating frequency of 0.915 or 2.45 GHz. However, the invention could also be employed with other frequencies. As shown, microwave oven 2 includes a housing 5 defining an internal oven cavity 7. Housing 5 includes an opening 10 permitting entry into oven cavity 7. Although not shown, a corresponding opening is provided at an opposing end of housing 5 to establish an exit from oven cavity 7. A door assembly, generally indicated at 15, is provided to selectively close oven cavity 7 at opening 10. In the preferred embodiment shown, door assembly 15 includes a pair of posts 25*a* and 25*b* mounted upon a support plate 26 on either side of opening 10 to oven cavity 7. The door assembly 15 further includes a pair of guides 27*a* and 27*b* which are adapted to slide about posts 25*a* and 25*b* respectively, to allow door assembly 15 to guided vertically between open and closed positions.

Microwave oven 2 further includes a conveyor belt 35 which is adapted to transport a food item 40 through opening 10 and into oven cavity 7. Conveyor 35 traverses the entire length of oven cavity 7. When door assembly 15 is opened, conveyor belt 35 moves food item 40 into oven cavity 7. Door assembly 15 is then moved to the closed position and a magnetron (not shown) is activated to initiate a cooking operation upon food item 40 within oven 2. Upon completion of the cooking operation, such as on a timed basis, food item 40 exits oven cavity 7 at an end of housing 5 opposite opening 10. Therefore, oven 2 is preferably never operated without door assembly 15 covering opening 10 to oven cavity 7.

In general, the above-described structure of microwave oven 2 is known in the art and does not constitute part of the present invention. Therefore, this structure has only been described for the sake of completeness and is set forth in more detail in U.S. Pat. No. 5,958,278 which is hereby incorporated by reference. The present invention is particularly directed to a shielding system, which is fixedly mounted within oven cavity 7 and functions to protect select portions of food item 40 from the full effects of a generated microwave energy field, as will be described in detail below.

Figure 2:
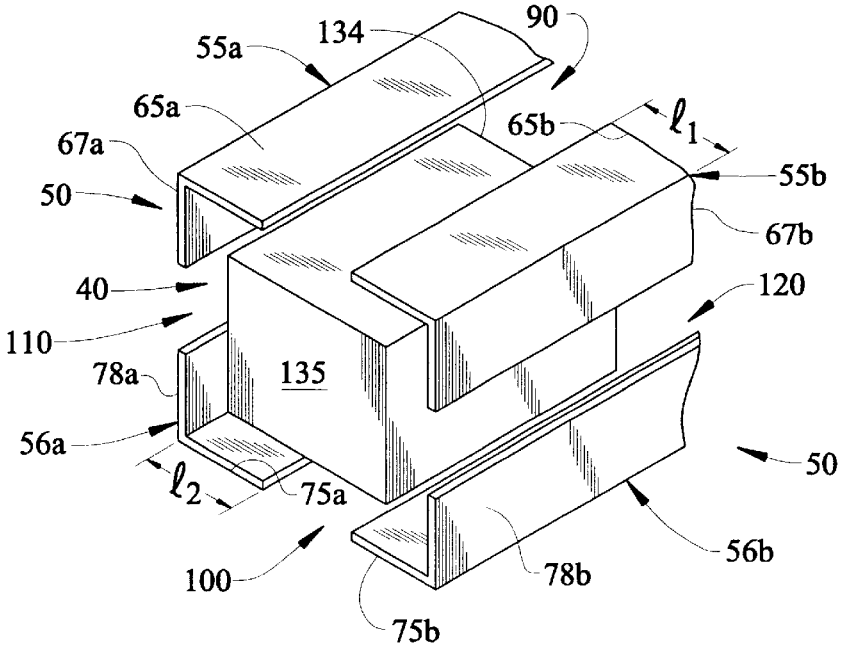
FIG. 2 is an isometric view of a section of the microwave shielding system of the present invention arranged about a food item.
Figure 3:
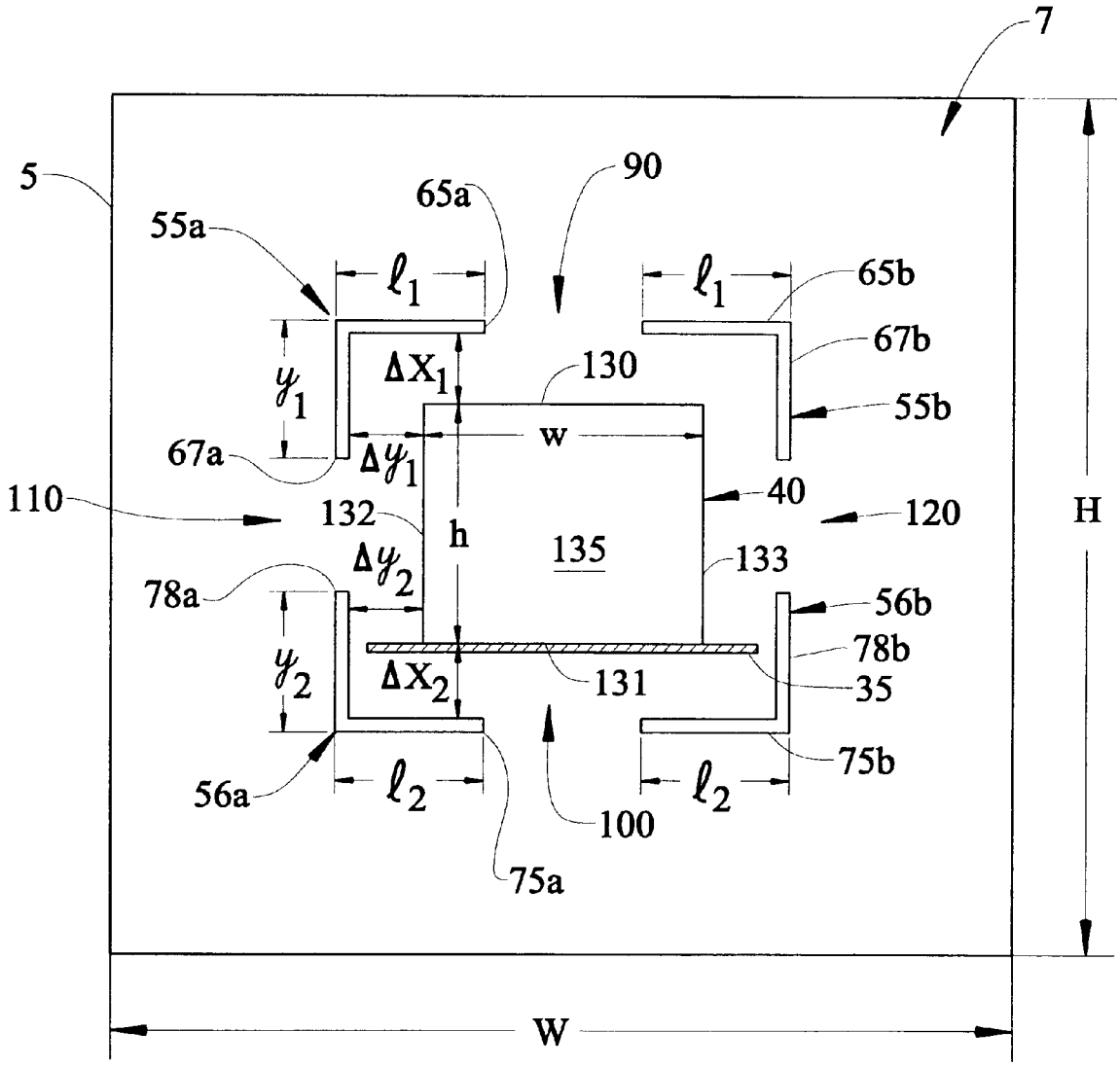
FIG. 3 is a front view of the shielding system of FIG. 2.

As shown in FIGS. 1–3, the shield system of the present invention includes a generally rectangular frame structure 50 constructed from a plurality of generally L-shaped members. More specifically, frame structure 50 includes a first upper member 55*a*, a second upper member 55*b*, a first lower member 56*a*, and a second lower member 56*b*. Members 55*a*, 55*b*, 56*a*, and 56*b* are fixedly supported within oven cavity 7 relative to conveyor belt 35, such as through the use of respective, spaced support elements 60. In accordance with the invention, members 55*a*, 55*b*, 56*a* and 56*b* are made from a material, such as metal, which is impermeable to microwave energy. In the most preferred form of the invention, upper members 55*a* and 55*b* combine to form uppermost shield portions 65*a* and 65*b*, each having a width $l_1$, and upper side shield portions 67*a* and 67*b*, each having a width $y_1$. Lower members 56*a* and 56*b* combine to form lowermost shield portions 75*a* and 75*b*, each having a width $1_2$, and lower side shield portions 78*a* and 78*b*, each having a width $y_2$.

As clearly shown in these figures, members 55*a*, 55*b*, 56*a* and 56*b* of frame structure 50 are spaced from one another so as to define a plurality of transmissive zones which are generally defined as gaps in frame structure 50. More specifically, located between upper portions 65*a* and 65*b* is an upper transmissive zone 90, and between lower portions 75*a* and 75*b* is a lower transmissive zone 100. Similarly, located between upper side portion 67*a* and lower side portion 78*a* is first side transmissive zone 110, and between upper side portion 67*b* and lower side portion 78*b* is second side transmissive zone 120. In general, transmissive zones 90, 100, 110 and 120 provide access to portions of food item 40, thereby enabling select portions of food item 40 to be directly exposed to microwaves generated within oven cavity 7.

At this point, it should be noted that the actual size and shape of each of members 55*a*, 55*b*, 56*a* and 56*b* and, correspondingly, the dimensions associated with transmissive zones 90, 100, 110 and 120, will vary depending on the size and shape of food item 40 being cooked. As indicated above and shown in the figures presented, food item 40 which, in accordance with a preferred embodiment of the invention is frozen and needs to be thawed within microwave oven 2, takes the form of a rather large parallelepiped. This configuration has a propensity to induce arcing at sharp corners or edges thereof while passing through oven cavity 7. However, as will be detailed more fully below, the shielding system of the invention provides an ample distance between food item 40 and frame members 55*a*, 55*b*, 56*a* and 56*b* to allow food item 40 to freely pass through oven cavity 7, while still functioning to reduce fields around the corners and edges and aiding in inducing surface waves on food item 40 which are essentially benign to arcing while still contribute to product heating. Further details of this arrangement will be set forth below in describing the preferred spatial relationship between food item 40 and frame structure 50.

As shown in FIG. 3, frame structure 50 forms a generally rectangular shield system through which food item 40 passes. As shown, food item 40 is in the form of a parallelepiped having an upper surface 130, a lower surface 131, a first side surface 132 and a second side surface 133. Of course food item 40 also includes a frontal side surface 134 and a rear side surface 135. As clearly shown in this figure but not separately labeled, each juncture between adjacent surfaces 130–135 defines a corner or edge of food item 40. In any event, as shown, an effective space or clearance $\Delta x_1$, is established between upper surface 130 of food item 40 and upper portions 65*a*, 65*b*, while a space or clearance $\Delta x_2$ is established between lower surface 131 of food item 40 and lower portions 75*a*, 75*b*. Likewise, a space or clearance $\Delta y_1$ is established between each of surfaces 132 and 133 of food item 40 and a respective adjacent upper side portion 67*a*, 67*b*, while surfaces 132 and 133 are spaced from lower portions 78*a* and 78*b* of frame structure 50 by a distance $\Delta y_2$. In accordance with the invention, each of $\Delta x_1$, $\Delta x_2$, $\Delta y_1$ and $\Delta y_2$ are less than $\lambda/4$, where $\lambda$ equals the wavelength of the microwaves generated within oven cavity 7. However, it should be understood that these dimensions establish upper limits and some practical lower limit, e.g. 0.5 inches (1.27 cm) must be maintained such that food item 40 does not come in contact with frame structure 50.

In the most preferred embodiment of the invention wherein oven cavity 7 has an associated width W and height H, while the various frame members 55*a*, 55*b*, 56*a* and 56*b* have the widths outlined above, both W an H are made much greater than the wavelength $\lambda$ of the microwaves such that a multi-mode oven cavity 7 is established and the various dimensions are related as follows:

$$\Delta x_1+\Delta y_1<1_1, y_1$$

and $$\Delta x_2+\Delta y_2<1_2, y_2$$

Based on the size of food item 40, the optimal spacing can be determined empirically. Too close a spacing $\Delta x_1$, $\Delta y_1$, $\Delta x_2$, $\Delta y_2$ will tend to concentrate the microwaves on sections of frame structure 50 which can cause overheating of portions of food item 40, too large a spacing $\Delta x_1$, $\Delta y_1$, $\Delta x_2$, $\Delta y_2$ will not afford shielding at these portions. Accordingly, spacing $\Delta x_1$, $\Delta y_1$, $\Delta x_2$ and $\Delta y_2$ is made greater than the thickness of the L-shaped frame members 55*a*, 55*b*, 56*a* and 56*b*, but less than the respective width w and height h of food item 40. It should also be understood that by scaling the above dimensions, the shielding system will accommodate other operating frequencies.

By forming the frame structure in the above specified manner, only surface waves can propagate in spaces 90, 10, 110 and 120 between frame members 55*a*, 55*b*, 65*a* and 65*b* and food item 40. By their nature, surface waves have a much smaller wavelength than other modes as their wavelength tends to be near $\lambda/\sqrt{\in}$, where $\in$ is the dielectric constant of food item 40. In this manner, the surface waves creep around the corners of food item 40 without tending to magnify the microwave field in a quasistatic fashion operative with longer wavelength modes. Experience has shown that the surface waves will propagate without significant loss on the surface of a frozen food item but, when thawed, the surface waves are quickly attenuated. In this fashion, any undesired heating above the freezing temperature of food item 40 is limited.

In the above discussion, it should be noted that frame structure 50 perturbs the microwave field in oven cavity 7, but is not the primary applicator of the microwave energy to food item 40. It has been shown that in some instances, frame structure 50 can itself carry energy axially and deliver energy to food item 40, at least at end portions thereof. For example, if frame structure 50 is in close proximity to a side of oven cavity 7, it is foreseeable that energy may propagate in a TEM-like mode with an E-field between frame structure 50 and the side of cavity 7. This would have a detrimental effect, contributing to heating at the corners of food item 40 especially at an output end of a tempering tunnel. Accordingly, to mitigate the possibility, frame structure 50 is preferably grounded at some point along its length.

Having described the preferred structure of the present invention, a preferred method of operation will now be set forth. Prior to commencing a cooking process, as outlined above, the shielding system of the present invention is appropriately sized for the type of food item to be heated. Once these parameters have been pre-established, an operator can initiate the cooking process in a manner known in the art. In general, food item 40 is placed on conveyor belt 35 and a motor (not shown) operates to advance food item 40 toward opening 10. As food item 40 nears opening 10, door assembly 15 is preferably, automatically operated to permit food item 40 to enter into oven cavity 7. Upon entry, door assembly 15 operates to seal food item 40 within oven cavity 7. As conveyor belt 35 advances food item 40, a magnetron (not shown) is activated such that a microwave energy field having a defined wavelength is generated within oven cavity 7 to initiate a thawing or cooking process. Conveyor 35 is operated at a pre-established rate allowing for sufficient time to ensure proper heating of food item 40 prior to food item 40 reaching an exit of microwave oven 2. During the heating process, or at least a substantial percentage thereof, food item 40 is contained within frame structure 50. After finishing the heating process, the microwave energy field is de-activated and food item 40 is delivered from oven cavity 7, preferably simultaneously with the introduction of a subsequent food item 40 into oven cavity 7.

Although described with reference to a preferred embodiment of the invention, it should be readily understood that various changes and/or modifications can be made to the invention without departing from the spirit thereof. For instance, although the shielding system as described above is constituted by various elongated metal members which are spaced to define microwave transmissive zones, the shielding system could also be formed from a single unit wherein the frame members formed from materials defining both microwave impermeable and transmissive zones. It is preferable to provide side access gaps 110 and 120 for food item 40 as, without such gaps, the impedance properties of spurious transmission modes that exist between frame members 55*a*, 56*a* and 55*b*, 56*b* and the walls of oven cavity 7 will be enhanced with respect to the axial power transmission. However, depending upon the size of food item 40, gaps 110 and 120 may be considered optional. Furthermore it should be understood that terms such as upper, lower, left, right and the like have been used for the sake of convenience based on the drawings presented. These terms should not be construed as limiting the scope of the present invention. It should also be understood that the above description is but a preferred method of performing the heating process. One of ordinary skill in the art would understand the present invention would be appropriate for a variety of conveyorized microwave systems, including those having multiple openings and door structures. In general, the invention is only intended to be limited by the scope of the following claims.

We claim:

1. A microwave oven comprising:

a housing defining an oven cavity, said oven cavity including an opening for the introduction of a food item to be microwaved in the oven cavity;

a conveyor extending into the oven cavity, said conveyor being adapted to support the food item within the oven cavity; and a shielding system fixedly mounted within the oven cavity, said shielding system including a plurality of members which are spaced apart within the oven cavity, impermeable to microwave energy, and adapted to extend about select portions of the food item at predetermined distances, wherein the select portions of the food item are exposed to a reduced microwave energy field while passing through the oven cavity on the conveyor.

2. The microwave oven according to claim 1, wherein select ones of said plurality of members extend both above and below the conveyor.

3. The microwave oven according to claim 1, wherein each of said plurality of members extends substantially entirely through the oven cavity.

4. The microwave oven according to claim 1, wherein said conveyor extends entirely through said shielding system and outside said housing.

5. The microwave oven according to claim 1, wherein each of said plurality of members includes both substantially vertical and horizontal portions.

6. The microwave oven according to claim 5, wherein the substantially horizontal portions of certain ones of the plurality of members extend below the conveyor, while the substantially vertical portions of the certain ones of the plurality of members extend above the conveyor.

7. The microwave oven according to claim 5, wherein each of said plurality of members are generally L-shaped in cross-section.

8. The microwave oven according to claim 7, wherein the select portions constitute corners of the food item, each of said L-shaped members extends about a respective one of the corners.

9. The microwave oven according to claim 5, wherein the substantially horizontal portions of certain ones of the plurality of members have an associated first length and are adapted to be spaced from the food item by a first distance, and the substantially vertical portions of the certain ones of the plurality of members have an associated second length and are adapted to be spaced from the food item by a second distance, wherein a sum of the first and second distances is less than the first length.

10. The microwave oven according to claim 9, wherein the sum of the first and second distances is also less than the second length.

11. The microwave oven according to claim 1, wherein the predetermine distances are each less than ¼λ, with λ being a wavelength of the microwave energy.

12. The microwave oven according to claim 1, further comprising: a door for selectively enabling access to the oven cavity through the opening, said door being adapted to be selectively closed upon the conveyor during heating of the food item within the oven cavity.

13. A method of shielding select portions a food item during processing in a conveyorized microwave oven comprising:

placing a food item on a conveyor which extends into and through the microwave oven;

operating the conveyor belt such that the food item is directed into the microwave oven wherein a microwave energy field is generated to heat the food item; and advancing the food item through a shielding system having microwave impermeable members fixedly mounted within the microwave oven thereby exposing select portions of the food item to only a reduced microwave energy field.

14. The method of claim 13, further comprising: directing the conveyor through the microwave oven with the shielding system extending both above, below and alongside the food item.

15. The method of claim 13, further comprising: maintaining a minimum first distance between the food item and substantially horizontal portions of the shielding system, as well as a minimum second distance between the food item and substantially vertical portions of the shielding system, as the food item is advanced through the microwave oven.

16. The method of claim 15, further comprising: assuring that a sum of the first and second distances is greater than a length of a respective one of the microwave impermeable members as the food item is directed through the microwave oven.

17. The method of claim 15, further comprising: establishing each of the first and second distances to be less than ¼λ, with λ being a wavelength of the microwave energy.

* * * * *